United States Patent [19]

Bainbridge et al.

[11] Patent Number: 4,824,339

[45] Date of Patent: Apr. 25, 1989

[54] PERISTALTIC PUMP CARTRIDGE

[75] Inventors: Marlene A. Bainbridge, Lakewood; Charles B. Powell, Westminster; P. Michael Finsterwald, Denver, all of Colo.

[73] Assignee: Cobe Laboratories, Inc., Lakewood, Colo.

[21] Appl. No.: 87,097

[22] Filed: Aug. 19, 1987

[51] Int. Cl.[4] ..... F04B 43/12

[52] U.S. Cl. ..... 417/477

[58] Field of Search ..... 417/474–477, 417/238, 360; 137/863; 291/7, 9

[56] References Cited

U.S. PATENT DOCUMENTS

| | | | |
|---|---|---|---|
| Re. 27,376 | 5/1972 | Pickup | 417/477 |
| 3,896,827 | 7/1975 | Robinson | 417/477 X |
| 4,333,088 | 6/1982 | Diggins | 417/477 X |
| 4,379,452 | 4/1983 | DeVries . | |
| 4,599,055 | 7/1986 | Dykstra | 417/477 |
| 4,666,598 | 5/1987 | Heath et al. . | |
| 4,732,543 | 3/1988 | Hrycyshyn | 340/620 X |
| 4,735,558 | 4/1988 | Kienholz et al. | 417/477 |

FOREIGN PATENT DOCUMENTS 0134436 3/1985 European Pat. Off. .

OTHER PUBLICATIONS

Finsterwald et al., U.S. patent application Ser. No. 860,539, filed on May 7, 1986, entitled Improved Peristaltic Pump.

*Primary Examiner*—Carlton R. Croyle
*Assistant Examiner*—Eugene L. Szczecina, Jr.

[57] ABSTRACT

A peristaltic pump cartridge including a continuous flexible tube having two ends and a portion therebetween providing a U-shaped loop for use with a rotor and rollers to provide a peristaltic pump, a cartridge housing having supports for maintaining the portion of the flexible tube in the U-shaped loop external to the housing, the legs of the U-shaped loop leading into the housing, the housing having apertures through which connecting portions of the flexible tube remote from the U-shaped loop have been threaded from the interior to the exterior of the housing.

17 Claims, 2 Drawing Sheets

PERISTALTIC PUMP CARTRIDGE

FIELD OF THE INVENTION

The invention relates to cartridges used in peristaltic pumps.

BACKGROUND OF THE INVENTION

In one type of peristaltic pump, a flexible tube is compressed between rollers that are carried by a rotor and travel along a circular path and a race that has a surface adjacent to and concentric with the path of the rollers. As the occluded portion of the tube is advanced, the fluid in front of it is forced to travel through the tube.

A use of such a pump is in extracorporeal blood treatment. The peristaltic pumps have been provided on the front panel of a blood processing machine, employing flexible tube portions of a disposable tubing set that is changed for use with a different donor/patient. Some tubing sets have included cartridges that are removably mounted on the machine and carry flexible tubes in position to be acted upon by pump rollers on the front panel of the machine, e.g., DeVries U.S. Pat. No. 4,379,452; published European Patent Application 0,134,436; Heath et al., U.S. Ser. No. 748,545, filed June 25, 1985; and Finsterwald et al., U.S. Ser. No. 860,539, filed May 7, 1986.

In the Finsterwald et al. '539 patent application, there is description of a pump that self-loads a flexible tube portion placed in a tube mounting region adjacent to a tube pumping region between the race and the rollers, as the rollers rotate, owing to the action of a small diameter roller portion adjacent to the tube mounting region and a large diameter roller portion adjacent to the tube pumping region. When unloading the tube from the pump, a lifter arm extending from a movable cover lifts the tube out of the tube pumping region as the cover is moved away from the pump.

SUMMARY OF THE INVENTION

It has been discovered that a peristaltic pump cartridge could be desirably provided by a continuous flexible tube and a cartridge housing having supports for maintaining a portion of the tube in a U-shaped loop external to the housing and apertures through which connecting portions of the flexible tube remote from the U-shaped loop have been threaded from the interior to the exterior of the housing. By using a continuous tube, there are no junctions or connections to different pieces of tubing, simplifying manufacture and providing a smooth flow path without sharp edges, e.g., so as to reduce the chance of damage to blood components.

In preferred embodiments there are at least three apertures in the cartridge housing, permitting the same cartridge housing and tube to be used to provide cartridges with connecting tube portions in different orientations; the apertures are provided by slots through which the tube portions can be easily and removably threaded; the housing has opposing sidewalls that define a space between them for receiving a locating plate of a carriage on which the cartridge is mounted; the housing has tabs adapted to be releasably engaged by a latching mechanism of the carriage; and the continuous tube is part of a disposable tube set, and tube is threaded through apertures aligned with equipment remote from the cartridge for receiving portions of the tube set.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE

Figure 1:
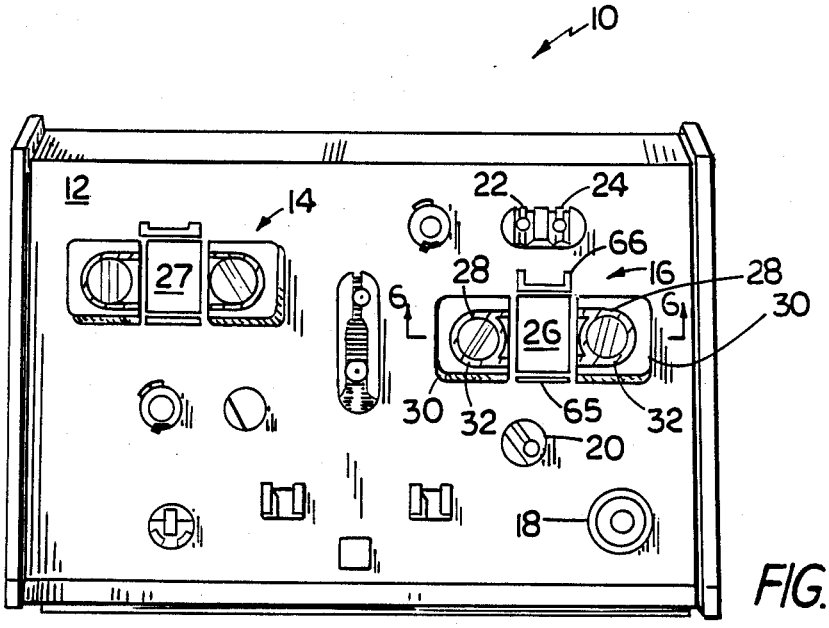
FIG. 1 is a perspective view of a front panel of a blood separation machine including a rotor and race for receiving a flexible tube portion carried by a cartridge in order to provide a peristaltic pump according to the invention.
Figure 2:
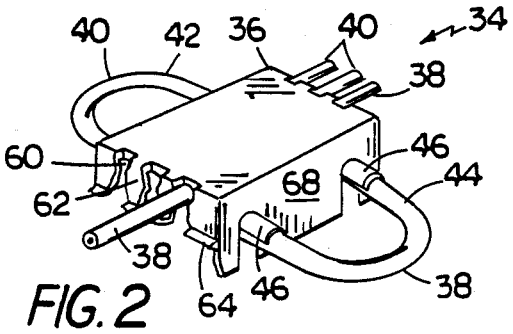
FIG. 2 is a perspective view of a cartridge for mounting on the FIG. 1 machine and carrying tube portions for use in a peristaltic pump according to the invention.
Figure 4:
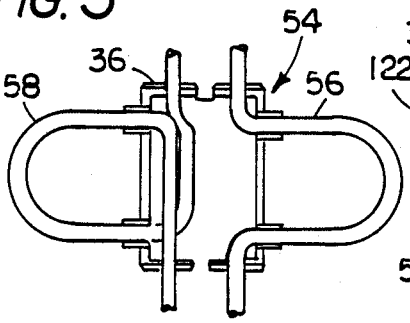
FIG. 4 is a bottom view of an alternative cartridge having tubes threaded in a different way than the FIG. 2 cartridge.

Referring to FIG. 1, there is shown centrifugal blood separation machine 10, including on its front face 12 two peristaltic pump units 14, 16 and various other components for interacting with components of a disposable tubing set (not shown) mounted on it, for example, platelet sensor 18, red blood cell return pinch valve 20, and 3-way plasma and collect pinch valves 22, 24. Pump units 14, 16 each includes a respective carriage 26, 27 for releasably engaging a respective cartridge 34, 54 (FIGS. 2, 4). Associated with, and on opposite sides of, each cartridge 34, 54 are two rotors 28 and corresponding races 30 defining tube pumping regions 32 therebetween for receiving U-shaped tube loops of the cartridges.

Referring to FIG. 2, there is shown cartridge 34, which is used with pump unit 14. Cartridge 34 includes plastic housing 36 and portions of two flexible tubes, anticoagulant tube 38 and blood inflow tube 40. These tubes are threaded through and supported within shell 36 and include U-shaped lops 42, 44 extending from opposite sides. Housing 36 includes four laterally extending curved guide supports 46 to which tubes 38, 44 are solvent bonded. Supports 46 maintain the tube portions between them in U-shaped loops. Housing 36 includes six slots 48, three at top wall 50 and three at bottom wall 52. In cartridge 34, one end of tube 38 extends upward from top wall 50 and is connected to a bag of anticoagulant (not shown) and the other end extends downward for joining with blood inflow tube 40 upstream of pump unit 14. Both ends of tube 40 extend from bottom wall 52 of housing 36. Pump cartridge 54, used with pump unit 16, employs an identical housing 36, but has a different tube arrangement; platelet tube 58 and plasma tube 56 each enter housing 36 through slots in the bottom wall and pass through respective slots in the top wall of housing 36. Both tubes 56, 58 have the same direction of flow (top to bottom)

for direction of a given rotation of rotors, even though the loops extend in opposite direction, because loop 58 overlaps itself. Slots 48 include aperture 60, large enough to hold a connecting portion of a tube therein without deformation of the tube, and narrow neck 62, which leads to aperture 60 and requires deformation of the tube when the tube passes through it. Top wall 50 and bottom wall 52 of housing 36 include tabs 64, for engaging recesses on carriage 26 in lower portion 65 and recesses in movable top portion 66. Side walls 68 of housing 36 extend downward further than top and bottom walls 50, 52 and are sized to mate with the outside surfaces of base plate 70 of carriage 26 (FIG. 6).

Figure 5:
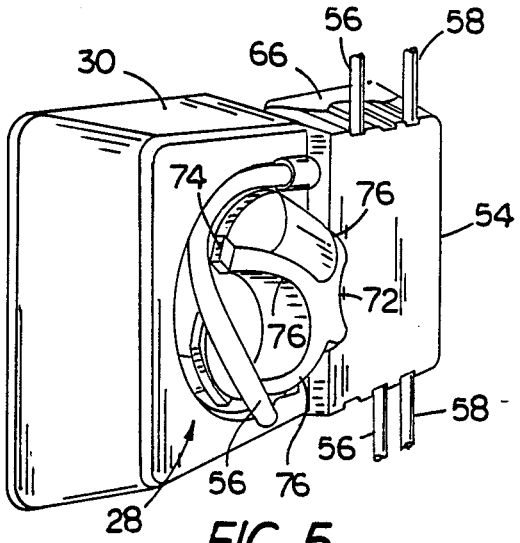
FIG. 5 is a perspective view showing a portion of the FIG. 4 cartridge being loaded into a tube pumping region between a race and rotor of the FIG. 1 machine.
Figure 3:
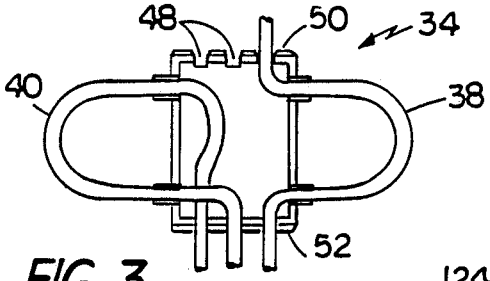
FIG. 3 is a bottom view of the FIG. 2 cartridge.
Figure 6:
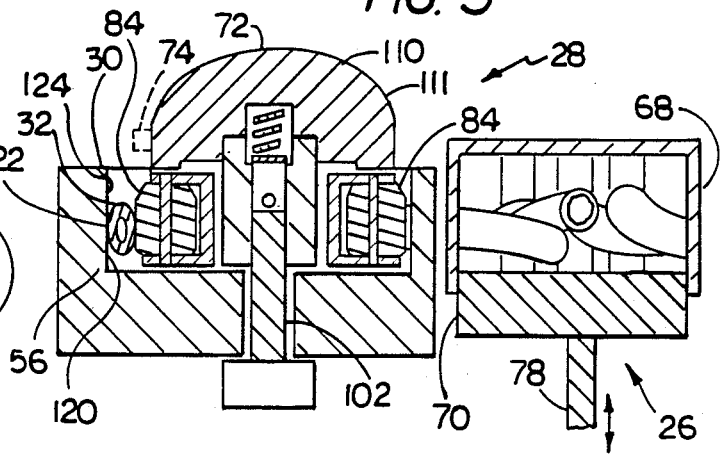
FIG. 6 is a partial vertical sectional view taken at 6—6 of FIG. 1 when a cartridge is mounted on the apparatus.
Figure 7:
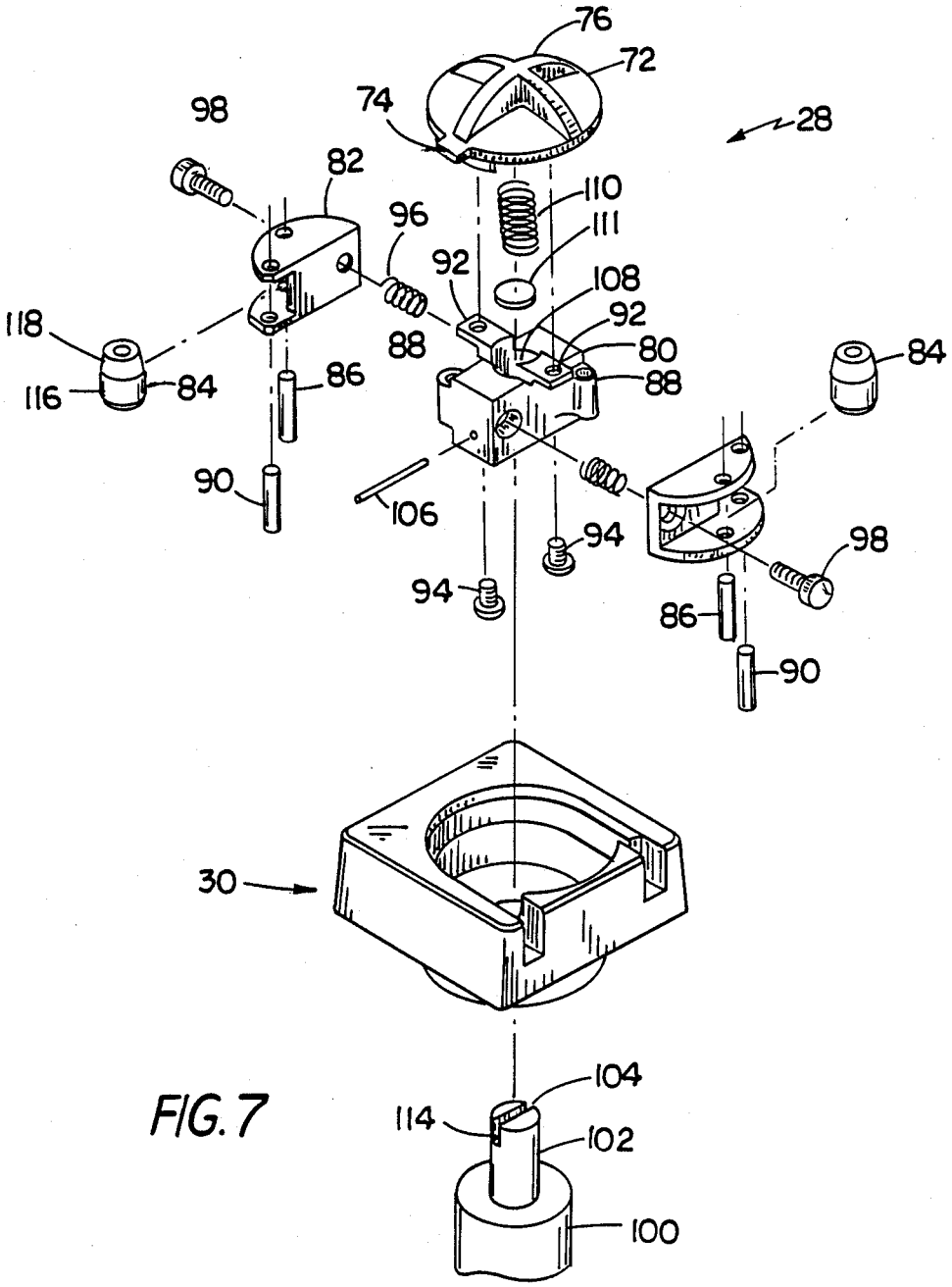
FIG. 7 is an exploded perspective view of a race and rotor of the FIG. 1 machine.

Referring to FIGS. 5, 6, and 7, it is seen that rotor 28 includes cap 72 having radially extending tab 74 outside of tube pumping region 32. In FIG. 6, tab 74 is shown in phantom and rotated 90° from its true position with respect to rollers 84 (as can be seen from FIG. 7). Cap 72 also has four outwardly curved ribs 76, making cap 72 substantially dome-shaped. Carriage base 70 is connected for vertical movement to linear actuator shaft 78. Referring to FIG. 7, rotor 28 includes base 80 and a pair of pivotally mounted yokes 82 for rotatably supporting rollers 84 about shafts 86. Yokes 82 are pivotally mounted at ears 88 of base 80 via pins 90. Cap 72 is secured to ears 92 of base 80 via screws 94. Yokes 82 are spring biased radially outward via compression springs 96 and are prevented from unlimited outward travel via stop screws 98. Variable speed motor 100 includes motor adapter shaft 102, which passes vertically through vertical hole 108 of base 80 and has a bayonet-type slot 104 for releasably engaging pin 106, which is secured to base 80 and passes through hole 108. Compression spring 110 is between cap 72 and plate 111, which rests on the top of adapter shaft 102. Spring 110 biases base 80 upward, thereby locking pin 106 in vertically directed end 114 of bayonet slot 104. Each roller 84 has 0.50" high and 0.480" diameter cylindrical large diameter portion 116 and 0.360" to 0.365" high conical smaller diameter portion 118 having a 4°±30′ angle and ending at a diameter of 0.429" at its top. Tab 74 extends outward from cap 72 (which is 1.80" in diameter) by 0.100". Inner surface 120 of race 30 includes a large diameter portion 122 and a conical small diameter portion 124 having a similar shape to roller 84.

OPERATION

In operation, a disposable tubing set including cartridge 34 and cartridge 54 is mounted on machine 12, the mounting including snapping cartridge 34 onto carriage 27 of pump unit 14 and snapping cartridge 54 onto carriage 26 of pump unit 16, the tabs 64 engaging respective recesses at bottom 65 and top 66 of carriages 26, 27. U shaped tube loops 42, 44 are initially outward of tab 74 (i.e., above tab 74 in FIG. 6), linear actuator shaft 78 being raised upward in an initial preloading position. U-shaped tube loops 42, 44 are loaded into pump units 14, 16 by rotation of rotors 28 and movement toward the face of machine 12 of linear actuator shaft 78. As tube loops 42, 44, are moved toward the face of machine 12, the curved portions of the loops are guided by dome-shaped ribs 76 and eventually move into the path of travel of tabs 74 and are engaged by them and displaced toward tube pumping region 32 between the rollers and the race as shown in FIG. 5. The tube is brought into contact with conical small diameter portion 118 of roller 84, and then travels along the surface of conical portion 118 toward the larger diameter base of conical portion 118 and self-aligns at large diameter portion 116, owing to the difference in radius of the portions of the rollers, as linear actuator continues downward to the position shown in FIG. 6. Tube loops 42, 44 maintain their aligned positions at large diameter portions 116 of rollers 84. Because a continuous tube is used, there are no junctions or connections to different pieces of tubing, simplifying manufacture and providing a smooth flow path without sharp edges for the blood and separated blood components, reducing chance of damage to blood components.

To unload tube loops 42, 44, rotor 28 rotates while linear actuator 78 moves the cartridge outward from the front panel of the machine. The straight leg portions of U-shaped tube loops 42, 44 thus also tend to be pulled outward, while the portions engaged by the roller tend to be maintained at the large diameter portion. Eventually each tab 74 engages a respective lower surface of tube loop 42 or 44 near the junction of the straight leg portion with the portion engaged by the rollers and lifts it up outward, preventing engagement by the following roller.

What is claimed is:

1. A peristaltic pump cartridge comprising:

a continuous flexible tube having two ends and a portion therebetween providing a U-shaped loop for use with a rotor and rollers to provide a peristaltic pump.

a cartridge housing having supports for maintaining said portion of said flexible tube in said U-shaped loop external to said housing, the legs of said U-shaped loop leading into said housing.

said housing having apertures through which connecting portions of said flexible tube remote from said U-shaped loop have been treaded from the interior to the exterior of said housing, said housing having at least three apertures, at least one said aperture not having a tube passing through it, permitting the same cartridge housing and tube to be used to provide cartridges with connecting tube portions in different orientations.

2. The cartridge of claim 1 wherein said housing has a plurality of walls, and said apertures are in at least two said walls.

3. The cartridge of claim 2 wherein said apertures are in two opposing walls.

4. The cartridge of claim 1 wherein said housing has supports for maintaining portions of two flexible tubes in U-shaped loops external to said housing.

5. The cartridge of claim 4 wherein said U-shaped loops are on opposite sides of said housing.

6. The cartridge of claim 4 wherein said housing has at least five apertures, whereby the connecting portions of said flexible tube remote from said U-shaped loops may be selectively threaded through varying combinations of apertures, permitting alignment of said remote portions with equipment external to said cartridge.

7. The cartridge of claim 6 wherein said housing has apertures on opposite sides.

8. The cartridge of claim 1 wherein said housing comprises a pair of opposing sidewalls defining a space therebetween adapted to receive a locating plate of a carriage on which said cartridge is mounted.

9. The cartridge of claim 1 wherein said housing comprises tabs adapted to be releasably engaged by a latching mechanism of a carriage on which said cartridge is mounted.

10. The cartridge of claim 9 wherein said housing comprises a pair of opposing sidewalls on which said tabs are located.

11. A peristaltic pump comprising the cartridge of claim 1 and a carriage adapted to releasably engage said housing, a rotor carrying rollers and a race defining a tube pumping region therebetween and positioned with respect to said carriage so as to receive said U-shaped loop in said tube pumping region.

12. The pump of claim 11 wherein said housing includes a pair of opposing sidewalls defining a space therebetween, and said carriage includes a locating plate that is received in said space to accurately locate said housing on said carriage.

13. The pump of claim 11 wherein said housing includes tabs, and said carriage includes a latching mechanism that releasably engages said tabs.

14. The pump of claim 13 wherein said housing comprises a pair of opposing sidewalls on which said tabs are located.

15. The pump of claim 14 wherein said housing has at least three said apertures in different positions, and wherein said continuous tube is part of a tube set, and further comprising equipment for receiving portions of said tube set, said equipment being aligned with said apertures.

16. A peristaltic pump cartridge comprising:

a continuous flexible tube having two ends and a portion therebetween providing a U-shaped loop for use with a rotor and rollers to provide a peristaltic pump, a cartridge housing having supports for maintaining said portion of said flexible tube in said U-shaped loop external to said housing, the legs of said U-shaped loop leading into said housing, said housing having apertures through which connecting portions of said flexible tube remote from said U-shaped loop have been threaded from the interior to the exterior of said housing, wherein said housing comprises a plurality of sidewalls, and said apertures comprise slots in at least one said sidewall permitting said connecting tube portions to be easily and removably threaded in said housing by moving said connecting tube portions in a direction parallel to the plane of said one sidewall.

17. The cartridge of claim 16 wherein said slotted apertures each include a narrow passage, whereby said flexible connecting tube portion must be deformed to permit passage of said connecting tube portion through said slotted aperture.

* * * * *